US011155890B2

(12) United States Patent
Makwana et al.

(10) Patent No.: US 11,155,890 B2
(45) Date of Patent: Oct. 26, 2021

(54) TUYERE FOR A BASIC OXYGEN FURNACE

(71) Applicant: Air Products and Chemicals, Inc., Allentown, PA (US)

(72) Inventors: Anandkumar Makwana, Breinigsville, PA (US); Anup Vasant Sane, Allentown, PA (US); Michael David Buzinski, Slatington, PA (US); Gregory J. Buragino, Fogelsville, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 127 days.

(21) Appl. No.: 16/514,122

(22) Filed: Jul. 17, 2019

(65) Prior Publication Data

US 2021/0017616 A1 Jan. 21, 2021

(51) Int. Cl.
*C21B 7/16* (2006.01)
*F27D 3/16* (2006.01)
(Continued)

(52) U.S. Cl.
CPC ..... *C21C 5/34* (2013.01); *C21B 7/16* (2013.01); *C21C 5/4673* (2013.01); *F27D 3/16* (2013.01);
(Continued)

(58) Field of Classification Search
CPC ..... C21C 5/34; C21C 5/4673; C21C 5/48; C21B 7/16; C21B 7/163; F27D 3/16; F27D 2003/167; F27D 2027/002
See application file for complete search history.

(56) References Cited

U.S. PATENT DOCUMENTS 3,867,136 A * 2/1975 Eriksson ..... C21C 7/0685 75/557
4,417,723 A 11/1983 Kitamura et al.
(Continued)

FOREIGN PATENT DOCUMENTS

EP 2047001 4/2009
WO 2008002585 1/2008

OTHER PUBLICATIONS

K.J. Barker, et al, "Chapter 8: Oxygen Steelmaking Furnace Mechanical Description and Maintenance Considerations", The Making, Shaping and Treating of Steel: Steelmaking and Refining Volume, 11th Edition, AIST, 1998.
(Continued)

*Primary Examiner* — Scott R Kastler
(74) *Attorney, Agent, or Firm* — Larry S. Zelson

(57) ABSTRACT

A tuyere comprising an inner tube including a lower section having a first diameter, an upper section having a second diameter smaller than the first diameter, and a converging transition section having a converging angle Θ from 30° to 60° connecting the lower section to the upper section, the inner tube terminating in an inner nozzle at a downstream end of the upper section; and an outer tube surrounding the inner tube so as to create an annulus there between, the outer tube including a lower section having a third diameter larger than the first diameter, an upper section having a fourth diameter smaller than the third diameter but larger than the second diameter, and a converging transition section having connecting the lower section to the upper section, the outer tube terminating in an outer nozzle at a downstream end of the upper section.

6 Claims, 9 Drawing Sheets

(51) Int. Cl.

| | |
|---|---|
| ***C21C 5/34*** | (2006.01) |
| ***C21C 5/46*** | (2006.01) |
| *F27D 27/00* | (2010.01) |

(52) U.S. Cl.
CPC .. *F27D 2003/167* (2013.01); *F27D 2027/002* (2013.01)

(56) References Cited

U.S. PATENT DOCUMENTS

| | | | | |
|---|---|---|---|---|
| 4,758,269 | A | 7/1988 | Tommaney | |
| 5,329,545 | A | 7/1994 | Dudill et al. | |
| 5,458,320 | A | 10/1995 | Winchester et al. | |
| 6,322,610 | B1 * | 11/2001 | Pavlicevic | C21C 5/4606 75/554 |
| 2007/0096373 | A1 * | 5/2007 | Khloponin | B22D 1/005 266/218 |
| 2017/0356645 | A1 | 12/2017 | Miller et al. | |
| 2021/0017616 | A1 * | 1/2021 | Makwana | C21C 5/48 |

OTHER PUBLICATIONS

T.W. Miller et al, "Chapter 9: Oxygen Steelmaking Processes", The Making, Shaping and Treating of Steel: Steelmaking and Refining Volume, 11th Edition, AIST, 1998.

Z. Guoguang, et al, "Experience with long BOF campaign life and TBM bottom stifling technology at Meishan Steel in China", 2012, 61-78.

L. Farmer, et al, "Gas injection tuyere design and experience", 72nd Steelmaking Conference Proceedings, 1989, 487-495.

K. Mills, et al, "A review of slag splashing", ISIJ International, vol. 45.5, 2005, 619-633.

* cited by examiner

| Top Flow | Cases | Step 1 | Step 2 | Step 3 | Step 4 | Step 5 |
|---|---|---|---|---|---|---|
| | Oxygen | No | Yes | Yes | No | No |
| | Nitrogen | No | No | No | No | Yes |

| | Gases | Step 1 | Step 2 | Step 3 | Step 4 | Step 5 |
|---|---|---|---|---|---|---|
| Top Flow | Oxygen | No | Yes | Yes | No | No |
| | Nitrogen | No | No | No | No | Yes |
| | Argon | No | No | Yes | Yes/No | Yes/No |
| Bottom Flow | Nitrogen | Yes | Yes | No | Yes/No | Yes/No |
| | Fuel | No | No | No | Yes | Yes |
| | Oxygen | No | No | No | Yes | Yes |

TUYERE FOR A BASIC OXYGEN FURNACE

BACKGROUND

This application relates to a tuyere for improving the operability of using inert gas to bottom stir a basic oxygen furnace (BOF).

BOF's have been commonly used since the mid-20th century to convert pig iron into steel, primarily by the use of oxygen to remove carbon and impurities. The BOF was an improvement over the earlier Bessemer process that blew air into the pig iron to accomplish the conversion. In a BOF, blowing oxygen through molten pig iron lowers the carbon content of the metal and changes it into low-carbon steel. The process also uses fluxes of burnt lime or dolomite, which are chemical bases, to promote the removal of impurities and protect the lining of the vessel.

In the BOF, oxygen is blown at supersonic velocity into the bath using a top lance, which causes an exothermic reaction of oxygen and carbon, thereby generating heat and removing carbon. The ingredients, including oxygen, are modeled and the precise amount of oxygen is blown so that the target chemistry and temperature are reached within about 20 minutes.

The metallurgy and efficiency of the oxygen blowing are improved by bottom stirring (which may also be called combined blowing); basically, stirring the molten metal by introduction of gas from below improves the kinetics and makes the temperature more homogeneous, enabling better control over the carbon-oxygen ratio and the removal of phosphorous.

It is relatively common outside of the US to use an inert gas, such as argon and/or nitrogen, for bottom stirring. Benefits of BOF bottom stirring include potentially higher yield and increased energy efficiency. However, BOF bottom stirring is not common in the US because of the poor reliability and difficulty maintaining the bottom stirring nozzles due to slag splashing practices commonly used in the US. Slag splashing helps improve refractory and vessel lifetime, but causes blockage of existing bottom stirring nozzles.

Even in non-US facilities that employ BOF bottom stirring, the lifetime of the existing bottom stirring nozzles, before they become clogged or occluded, is often significantly less than the length of a furnace campaign. For example, it is not uncommon for a BOF campaign to run ten thousand, fifteen thousand, or even twenty thousand heats, but the bottom stirring nozzles rarely last more than three to five thousand heats before they are no longer usable. Therefore, for at least half, and in some cases as much as 85% of the furnace campaign, bottom stirring is not available.

Historically, other operations introducing gases from beneath the molten metal have been used from time to time in steel making. For example, in the 1970's processes were developed to use oxygen for decarburization in steel making by injection of natural gas (or other gases used as coolants), along with the oxygen, through tuyeres having concentric nozzles (usually with oxygen flowing through the inner central nozzle and fuel flow through the outer annular nozzle). For example, a 100% bottom-blown (OBM) process uses natural gas to shroud the tuyeres that inject oxygen into the process. Some variants of this process have also been used, such as Q-BOP (basic oxygen process), which also injects powdered lime through the tuyeres. These method are described, for example, in Chapter 8: Oxygen Steelmaking Furnace Mechanical Description and Maintenance Considerations; Chapter 9: Oxygen Steelmaking Processes; Fruehan, R. J., The Making, Shaping and Treating of Steel: Steelmaking and Refining Volume, 11th Edition, AIST, 1998, ISBN: 0930767020; and at https://mme.iitm.ac.in/shukla/BOF%20steelmaking%20process.pdf. These processes usually end up with higher bottom wear and need bottom replacement midway through furnace campaigns.

In other instances, the inert gas flows are maintained at high flow rates all the time, even when bottom stirring is not needed to combat the potential for clogging, which is inefficient and uses excessive amounts of inert gases. See, for example, Mills, Kenneth C., et al. "A review of slag splashing." ISIJ international 45.5 (2005): 619-633); and https://www.jstage.jst.go.jp/article/isijinternational/45/5/45_5_619/_pdf.

In yet other instances, slag chemical compositions have been modified in combination with 50% higher flows used for stirring in the event that a clog is detected. See, for example, Guoguang, Zhao & Hüsken, Rainer & Cappel, Jürgen. (2012), Experience with long BOF campaign life and TBM bottom stirring technology, Stahl and Eisen, 132. 61-78 (which improved tuyere life to 8,000-10,000 cycles). However, these modifications require a great deal of process knowledge and control i.e. addition of MgO pellets and managing the CaO/SiO2 ratio depending on the [C]-[O] levels in the slag.

There have been a number tuyeres that have been designed and implemented in furnaces, but each has deficiencies.

For example, U.S. Pat. No. 4,417,723 describes a concentric double-tube tuyere that was designed to minimize erosion of the refractory wall by the back attack and, maintain a continuous gas blowing operation.

U.S. Pat. No. 5,329,545 describes a tuyere to be used for blowing oxygen and inert gas in an electric arc furnace. The tuyere was particularly developed to work with relatively shallow depth of molten metal in electric arc furnace to avoid formation of molten metal fountain. A narrow inner diameter tuyere creates sonic flow at lower volumetric flowrate of oxygen or inert gas.

U.S. Pat. No. 4,758,269 discloses a tuyere to blow oxygen, with improved gas distribution to improve the refining reactions and stirring, under molten steel bath. This tuyere has plurality of tubes through which the gas enters the metal bath in a spiral pattern. The device also facilitates control of area over which the bubbles would dispense in the ladle based on the pressure of the supply gas.

U.S. Pat. No. 5,458,320 teaches a three concentric pipes tuyere to inject gases into a bath of molten metal. The submerged tuyere was designed to form an optimized size accretion at the tube exit that would shield the tuyere from molten metal as well as not restrict the gas flow used for stirring.

SUMMARY

The present invention pertains to a device that can be used in furnaces for stirring metal bath to achieve homogeneity, in temperature and chemistry, of the bath quickly and thereby, achieve improved product quality. These devices or tuyeres could be used in metal melting or refining furnaces including, but not limited to, in ladles, basic-oxygen furnaces, copper refining furnace for bottom or side blowing operations.

Aspect 1. A tuyere comprising: an inner tube including a lower section having a first diameter, an upper section having a second diameter that is smaller than the first diameter, and a converging transition section having a converging angle θ from 30° to 60° connecting the inner tube lower section to the inner tube upper section, the inner tube terminating in an inner nozzle at a downstream end of the inner tube upper section; and an outer tube surrounding the inner tube so as to create an annulus there between, the outer tube including a lower section having a third diameter that is larger than the first diameter, an upper section having a fourth diameter that is smaller than the third diameter but larger than the second diameter, and a converging transition section having connecting the outer tube lower section to the outer tube upper section, the outer tube terminating in an outer nozzle at a downstream end of the outer tube upper section; wherein the tuyere is operable in two modes, a stirring mode in which a jet formed by the tuyere is in the jetting mode with an expansion Mach number from 0.75 to 2, preferably greater than 1.25, and a burner mode in which a stable non-premixed flame is formed to enable clearing of any blockage of the inner nozzle or the outer nozzle.

Aspect 2. The tuyere of Aspect 1, further comprising: a pair of diametrically opposed wires spirally wound around on outer surface of the upper section of the inner tube at a taper angle from 15° to 75°.

Aspect 3. The tuyere of Aspect 1 or Aspect 2, further comprising: a first inert gas valve configured to supply an inert gas to the inner tube and a fuel valve configured to supply a fuel to the inner tube; a second inert gas valve configured to supply an inert gas to the outer tube and an oxidant valve configured to supply an oxidant to the outer tube; and a controller programmed to operate the tuyere in a stirring mode or a burner mode, wherein in the stirring mode the first inert gas valve and the second inert gas valve are open while the fuel valve and the oxidant valve are closed, and wherein in the burner mode the fuel valve and the oxidant valve are open while the first inert gas valve and the second inert gas valve are closed.

Aspect 4. The tuyere of Aspect 3, further comprising: a first pressure sensor in a conduit upstream of the inner tube of the tuyere configured to send a signal to the controller indicative of a first back-pressure in the inner tube of the tuyere; and a second pressure sensor in a conduit upstream of the outer tube of the tuyere configured to send a signal to the controller indicative of a second back-pressure in the outer tube of the tuyere; wherein the controller is programmed to switch tuyere operation from the stirring mode to the burner mode when one or both of the first back-pressure and the second back-pressure deviates from a predetermined normal range of back-pressure in the tuyere.

Aspect 5. The tuyere of Aspect 3 or Aspect 4, further comprising: a temperature sensor configured to send a signal to the controller indicative of a temperature in the upper section of the outer tube of the tuyere; wherein the controller is programmed to switch tuyere operation from the stirring mode to the burner mode when the temperature deviates from a predetermined normal range of temperature in the tuyere.

Aspect 6. The tuyere of any one of Aspects 3 to 5, further comprising: a camera configured to send a visual image of the inner nozzle and the outer nozzle of the tuyere to the controller; wherein the controller is programmed to switch tuyere operation from the stirring mode to the burner mode when the visual image indicates partial blockage of one or both of the inner nozzle and the outer nozzle.

The various aspects of the system and method disclosed herein can be used alone or in combinations with each other.

BRIEF DESCRIPTION OF THE DRAWINGS

FIG. 2A shows a spiral wound wire for creating turbulence near the inner nozzle exit, and FIG. 2B shows grooves or notches in an outer wall of the inner nozzle for creating turbulence near the nozzle exit.

FIG. 10A shows a stable flame produced by the tuyere in the burner mode, and FIG. 10B shows a stable jet produced by the tuyere in a pool of water.

DETAILED DESCRIPTION

An inventive bottom or side stir tuyere is described herein to facilitate the use of bottom stirring in a BOF with improved reliability, timely detection/mitigation of problems, and easier maintenance of bottom stirring tuyeres, in an operation that also practices slag splashing. This tuyere will also enable BOF bottom stirring operations that do not currently utilize slag splashing to begin using slag splashing and obtaining the benefits thereof. The tuyere can be mounted in either the bottom or the sidewall of a BOF.

As used herein, oxidant shall mean enriched air or oxygen having a molecular oxygen concentration of at least 23%, preferably at least 70%, and more preferably at least 90%. As used herein, inert gas shall mean nitrogen, argon, carbon-dioxide, other similar inert gases, and combinations thereof. As used herein, fuel shall mean a gaseous fuel, which may include but is not limited to natural gas.

To allow bottom stirring to be used in a BOF that also employs slag splashing, the present inventors have determined that it is necessary to minimize the probability of clogging the bottom stir tuyeres and to have a tuyere nozzle flow structure that achieves the desired stirring condition both with a new BOF and under a bottom buildup condition resulting from successive slag splashing operations.

Figure 7:
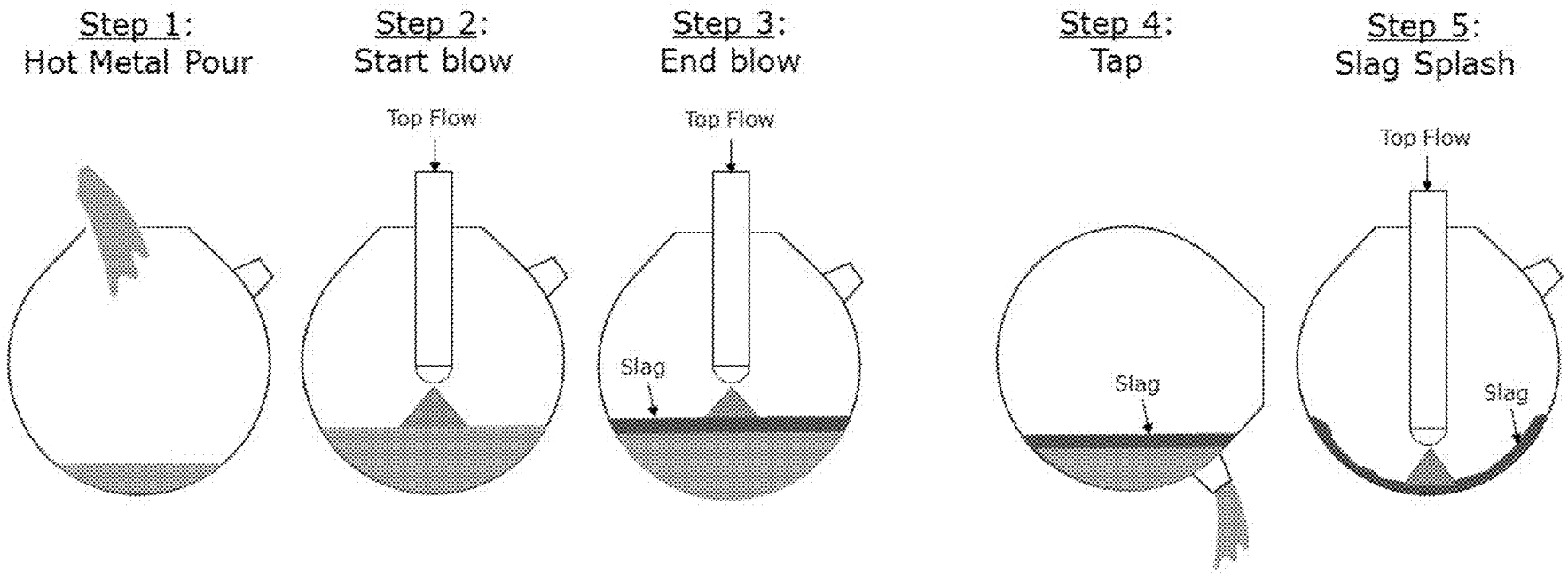
FIG. 7 is a schematic showing a sequence of operation of a baseline BOF steel making process without the use of bottom stirring.

A typical BOF steel making process has four phases, shown by way of five steps in FIG. 7: a pour phase (Step 1), a blow phase (started by Step 2 and ended by Step 3), a tap phase (Step 4), and a slag splash phase (Step 5). The cycle repeats, so after Step 5, the process recycles to Step 1.

In Step 1 (Hot Metal Pour), hot metal (pig iron) is loaded or poured into the furnace vessel through a top opening, to achieve a desired fill level.

In Step 2 (Start Blow), a flow of oxygen is injected through a lance inserted through the top opening of the furnace; during this process, slag is formed on the top surface of the molten metal. In Step 3 (End Blow), the flow of oxygen is stopped and the lance is removed from the top opening.

In Step 4 (Tap), the furnace is tilted and the molten metal is poured out through a tap on the side of the furnace, while the slag is left behind in the furnace.

In Step 5 (Slag Splash), the furnace is returned to an upright position and a flow of nitrogen is injected through a lance inserted through the top opening of the furnace. The nitrogen is flowed in large quantities (e.g., 20,000 SCFM) at supersonic velocities into the BOF, which causes the molten slag to splash all over the walls of the furnace vessel. This results in coating of the BOF vessel with a layer of protective slag, which in part replaces some of the vessel refractory that is consumed or eroded away during the BOF process. Slag splashing, however, if done in a vessel with bottom stir nozzles, often results in partial or complete clogging of the bottom stir nozzles located at the bottom of the vessel. This clogging essentially prevents or restricts further flow of gases through the bottom stir nozzles into the BOF, and eventually, after multiple slag splashing, results in losing the ability to bottom stir at all.

Thus, a major challenge with using a BOF bottom stirring tuyere is that over time the tuyere may develop partial or full blockage at the exit of the tuyere due to cooling of slag or metal from the stirring gas. Additionally, these blockages could be present at a downstream location from the tuyere exit. These types of blockages would not affect the flow of gas inside the tuyere; however, the effectiveness of the stirring is lost as the under-expanded jet gets diverted in other furnace areas. These blockages that form downstream of the tuyere are difficult to detect and eliminate as they do not essentially affect the flow characteristics of the fluid in the tuyere.

Additionally, submerged gas injection tuyeres are designed to operate in jetting regime. The operation of tuyere in jetting regime aids in decreasing the occurrence of back attacks on surrounding refractory walls and penetration of molten metal inside the tuyere. Criteria to achieve a stable jetting condition of operating tuyere are understood to be based on two variables: expansion Mach number and jet expansion angle. A jet with expansion Mach number of 1.25 and expansion half-angle of greater than 5° would be in a stable jetting regime. To achieve this stable jetting regime, the supply gas requirements is considerably high that necessitates use of compression devices. The use of these devices adds up to operating costs of tuyere.

The aim of current invention is to provide a tuyere that help eliminate above discussed short-comings while maintaining the advantages of the submerged gas stirring operation in a furnace. The current tuyere design achieves this objective by providing operation flexibility of the tuyere in two different operation modes. The two operation modes are stirring mode and a burner mode; the operation mode can be selected by use of a controller mechanism. It is further objective of the device to operate at pressures, while sustain a stable jetting condition and process flow requirement for effective stirring, that are achievable from a standard high-pressure storage vessel or an Air Separation Unit without the need of an external compressor.

Some previous unsuccessful attempts have been made to keep existing bottom stir nozzles open by flowing nitrogen through the bottom stir nozzles during slag splashing. Disclosed herein are a self-sustaining bottom stir tuyere to overcome previous difficulties, as well as a control system for use with such a tuyere. The self-sustaining tuyere is basically a concentric tube design, where one fluid is flowed through the inner central nozzle while another fluid is flowed through the outer annular nozzle. In the description that follows, the inner central nozzle may sometimes be referred to as the primary nozzle, and the outer annular nozzle may sometimes be referred to as the secondary nozzle. . . .

In one embodiment, the inner central passage is configured to selectively flow either fuel or an inert gas and the outer annular passage is configured to selectively flow either oxygen or an inert gas, depending on the phase of operation of the BOF. In an alternate embodiment, the inner central passage is configured to selectively flow either oxidant or an inert gas and the outer annular passage is configured to selectively flow either fuel or an inert gas, again depending on the phase of operation of the BOF.

More specifically, each stirring tuyere is made up of coaxial nozzles (pipe-in-pipe configuration), for example as shown in FIG. 10. The tuyere is installed in the BOF so that it has an exit end or hot tip facing into the furnace. During operation, fuel and oxygen, or alternatively an inert gas such as nitrogen, argon, or carbon-dioxide, are interchangeably introduced into both the inside and outside nozzles, depending on the phase of operation in the BOF.

The main role of the primary nozzle is to provide flow regimes that are effective for stirring e.g., jetting flows to prevent back attack. The main role of the secondary nozzle is to provide a means to flow oxidant or fuel and help stabilize a non-premixed flame during the slag splashing phase, by use of special features e.g., swirling flows.

The primary nozzle may have one of several configurations. For example, the primary nozzle may be a converging nozzle, a converging-diverging nozzle (to create supersonic flows), a cavity nozzle, or a combination of a converging-diverging nozzle with cavity. Additionally, the tuyere could have a single or multiple numbers of these diverging, converging or converging-diverging nozzles.

Figure 1:
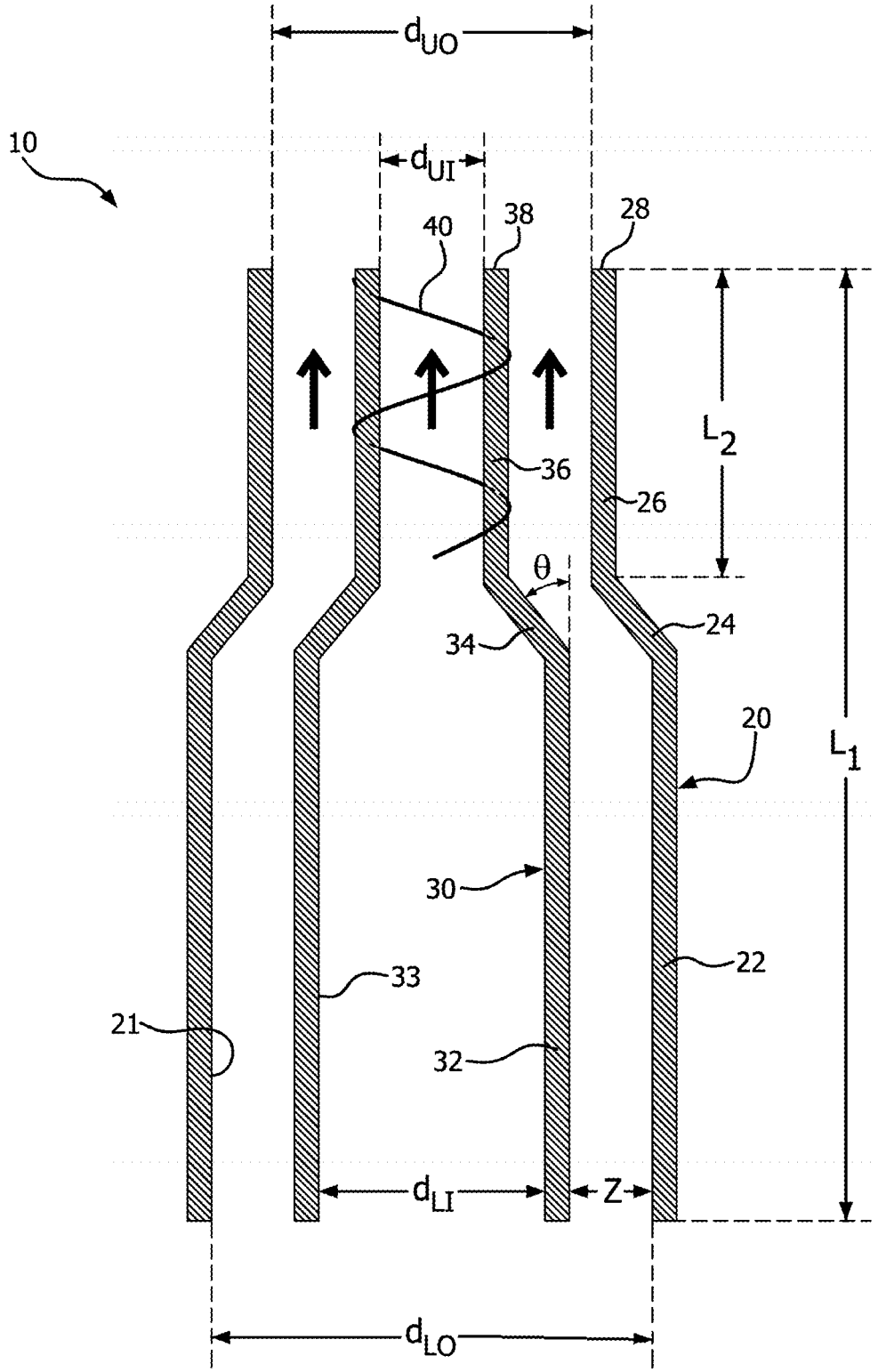
FIG. 1 is a side cross-sectional view of an embodiment of a tuyere for use in BOF bottom stirring. schematic.

FIG. 1 shows an embodiment of a tuyere 10 that can operate in two different modes: a stirring mode for submerged gas injection (where the jet formed by the tuyere 10 is in a jetting regime) and a burner mode (where fuel and oxidant are combusted to maintain the outlet of the tuyere from slagging over). In the stirring mode, the tuyere aids in proper mixing of the bath above it. In the burner mode, the tuyere provides a mechanism of cleaning of any blockage of the solidified or semi-solid matter at the exit of the tuyere. The tuyere thus enables itself to maintain the effectiveness of mixing in the stirring mode for a longer campaign by potentially removing any built up of material at the exit of the tuyere and increase the life campaign of the tuyere for a longer time by removing complete blockage at or further downstream from the exit of the tuyere.

In the embodiment of FIG. 1, the tuyere 10 includes two concentric tubes, an outer tube 20 and an inner tube 30. The outer tube 20 includes a lower section 22, a converging transitional section 24 downstream of the lower section 22, and an upper section 26 downstream of the converging transition section 24 that terminates in an outer or secondary nozzle 28. The inner tube 30 includes a lower section 32 aligned with the lower section 22 of the outer tube 20, a converging transitional section 34 aligned with the converging transitional section 24 of the outer tube 20, and an upper section 36 that terminates in an inner or primary nozzle 38.

The lower section 22 of the outer tube 20 has a diameter $d_{LO}$ and the upper section 26 of the outer tube 20 has a diameter $d_{UO}$, wherein the upper section diameter is smaller than the lower section diameter, and the converging transition section 24, which converges at an angle Θ that is preferably from 30° to 60° to join the lower section 22 and the upper section 26. Similarly, the lower section 32 of the inner tube 30 has a diameter $d_{LI}$ and the upper section 36 of the inner tube 30 has a diameter $d_{UI}$, wherein the upper section diameter is smaller than the lower section diameter, and the converging transition section 34, which converges at an angle Θ to join the lower section 32 and the upper section 36. The use of the converging transition sections 24, 34 helps to achieve a sonic flow condition at the exit of each respective tube at lower pressures than those achievable in the previous designs that consisted of a tube with single tube diameter.

Although the depicted embodiment shows that the primary nozzle 38 and the secondary nozzle 28 are aligned, in some cases it may be desirable to recess one of the nozzles with respect to the other by a desired length or non-dimensional length referencing the hydraulic diameter of one of the nozzles. In addition, although the inner tube 30 and the outer tube 20 will commonly be circular in cross-section, that geometry is not necessary to the successful operation of the tuyere 10 and in some cases non-circular cross-sectional tubes may be used.

The total length of the tuyere 10, $L_1$ is preferably in a range from about 40 inches to 55 inches, depending on the type of the application. The location of the downstream end of the converging transition sections 24, 34, designated to $L_2$, is preferably at about 10 inches to 20 inches from the nozzles 28, 38 of the tuyere 10. By setting the converging transition sections 24, 34 back from the nozzles 28, 38, the tuyere 10 can accommodate wear and erosion during its service life. However, for applications that do not observe any wear of tuyere 10, the converging nozzle could be located close to or at the nozzles 28, 38 of tuyere 10.

The area ratio of the lower section 32 to the upper section 36 for the inner tube 30 is preferably in range from 1 to 20, more preferably in range 5-10. For a circular inner tube 30, this translates to a diameter ratio of 1 to 4.5, and preferably a ratio of 2.2 to 3.2. In general, the larger the area ratio, the lower is the supply pressure required to achieve the same exit velocity at the exit of the converging transition section 34. The angle of taper, θ of the converging transition sections 24, 34 can be from about 15° to about 75°, preferably from about 30° to about 60°, and more preferably about 45°.

The diameter of the upper section 36, $d_{UI}$ of the inner nozzle 30 is preferably in range 2 to 12 mm, and more preferably in range 5 mm to 8 mm. The size of the exit face of the inner nozzle 38 is primarily determined by the need to reach jetting flow condition in stirring mode operation. The phenomenon of bubbling and jetting flow regime is well-established in the literature (see, e.g., Farmer L, Lach D, Lanyi M and Winchester D. Gas injection tuyere design and experience, 72nd Steelmaking Conference Proceedings, pg 487-495 (1989)), which established that for a jet to be in a stable jetting regime, the fully expanded Mach number should be greater than 1.25. Jetting flow helps to: (a) prevent back attack on the bottom refractory, and (b) achieve more effective stirring. Jetting flow is achieved when there is sufficient gas pressure to develop an underexpanded jet (when pressure of the gas exiting the tuyeres is greater than the pressure or static head of the surrounding fluid) such that a continuous flow of gas (no bubble formation) is generated to prevent periodic backflow of liquid (metal/slag) into the tuyere.

The diameter of the lower section 32, $d_{LI}$ of the inner nozzle 30 is preferably in range 5 to 30 mm, and more preferably in range 8 mm to 16 mm.

The diameter of the upper section 26 of the outer nozzle 20, $d_{UO}$ is set such that the ratio of velocity of fluids in burner mode at the exit of the inner nozzle 38 to the outer nozzle 38, $v_{inner}/v_{outer}$ is preferably in range 1 to 5, and more preferably about 2.

The diameter of the lower section 22 of the outer nozzle 20, $d_{LO}$ is set such that the distance between an inner surface 21 of the outer nozzle 30 and an outer surface 33 of the inner nozzle 30 is a constant that is equal to distance, z.

Preferably, the oxidant is pure oxygen with greater than 90% purity and natural gas is the fuel. However, any other oxidant and fuel combination, as deemed by a specific reason and known in the art, may be used.

During stirring mode, the inner nozzle 38 and outer nozzle 28 would preferably discharge an inert gas. During burner mode, the inner nozzle 38 would preferably flow a gaseous fuel and the outer nozzle 28 would preferably flow an oxidant. The oxidant to gaseous fuel ratio is preferably such that there is sufficient oxidant for complete combustion of the gaseous fuel. However, based on application a fuel-lean or fuel-rich flame could be used. The firing rate (MMBtu/hr) of the tuyere in burner mode would be dependent on the application type; the firing rate can be in range 0.1-3 MMBtu/hr, preferably in range 0.1-1 MMBtu/hr and more preferably in range 0.2-0.5 MMBtu/hr. The oxidant-fuel mixture ignites preferably due to the energy (high temperature or heat) from the surrounding or by use of an external ignition source.

Figure 2A:
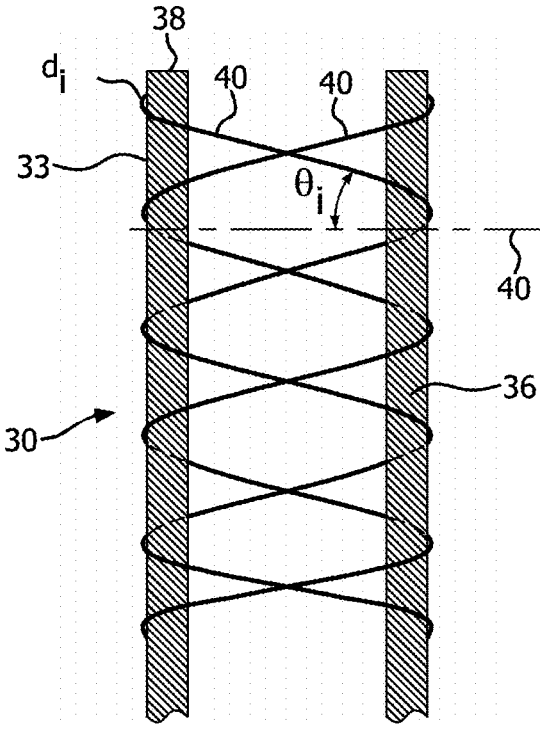
FIGS. 2A and 2B are side cross-sectional views of an inner nozzle of a tuyere as in FIG. 1 with mechanisms for assisting in creating a stable flame.
Figure 2B:
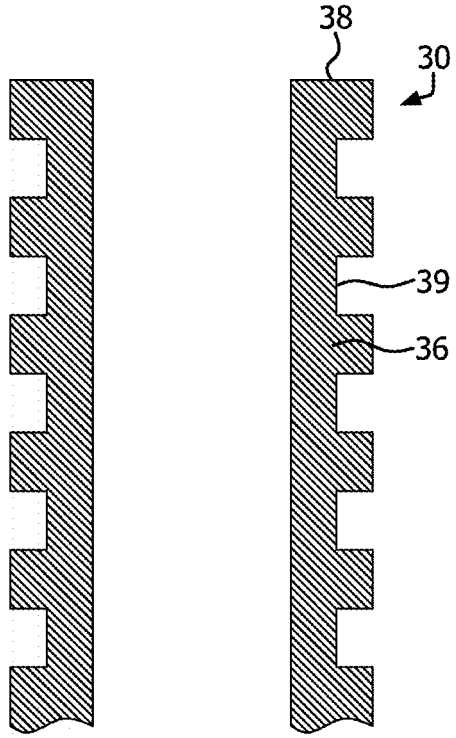

In burner mode of the tuyere 10, to facilitate stable flame operation without a continuous external ignition source, a swirl is imparted to the fluid in the secondary nozzle by use of two wires 40. The two wires 40 are wrapped on the outer surface face 33 of the inner tube 30 along at least a portion of the upper section 36 in a helical pattern as shown in FIG. 1 and in further detail in FIG. 2A. Alternatively, grooves 39 could be used in place of wires 40, as shown in FIG. 2B. The wires 40 are wrapped at an angle of helix, $\theta_i$, that is preferably in range 30° to 60°, more preferably around 40° to 50°. The start positions of the two wires 40 are 180 degree apart such that the wires 40 aid to create a symmetric flow field of the fluid from the outer nozzle 28, at the outlet of the tuyere 10 (in region 54 shown in FIG. 3), within region 52 created by the fluid from the inner nozzle 38.

Figure 3:
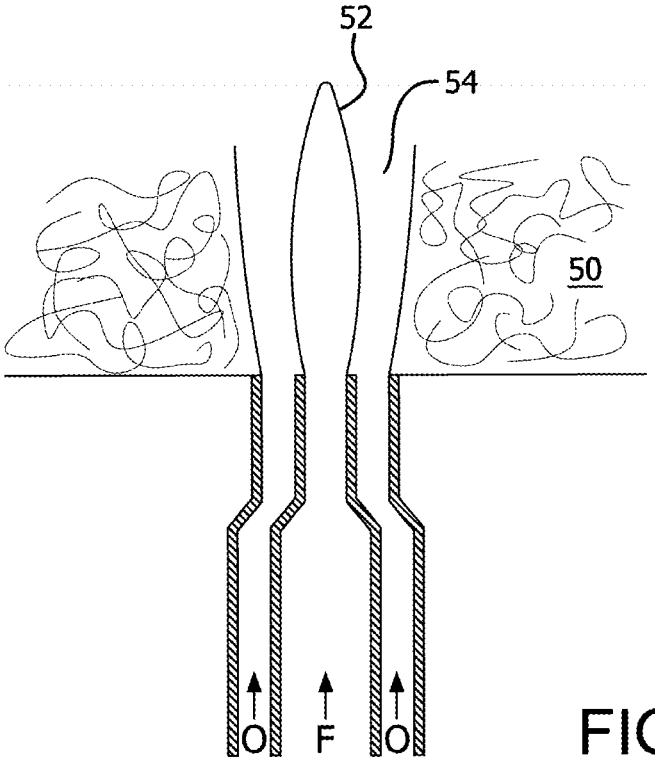
FIG. 3 is a side cross-sectional view of a tuyere as in FIG. 1 operating in burner mode.

The two wires 40 are preferably spiral wrapped for some or all of the length $L_2$ of the outer surface 33 of the inner tube 30. The presence of the wires 40 throughout the length $L_2$ would aid in providing swirl to the fluid in outer tube 20 even when the tuyere 10 wears down for any reason. The length $L_2$ is defined as the distance from the downstream end of the converging transition section 34 to the outlet plane of the inner nozzle 38. The wires 40 facilitate intense mixing of fuel, oxidant and combustion products leading to a stable flame. A good mixing of fuel and oxidant also helps to prevent flame disturbance from the surrounding molten or solidified process fluid 50 as shown in FIG. 3. The process fluid could be a molten metal or slag or a mixture of slag and a metal. The wires have a diameter $d_i$ preferably about one-third the distance z between the outer surface 33 of inner nozzle 30 and inner surface 21 of the outer nozzle 20.

Figure 4:
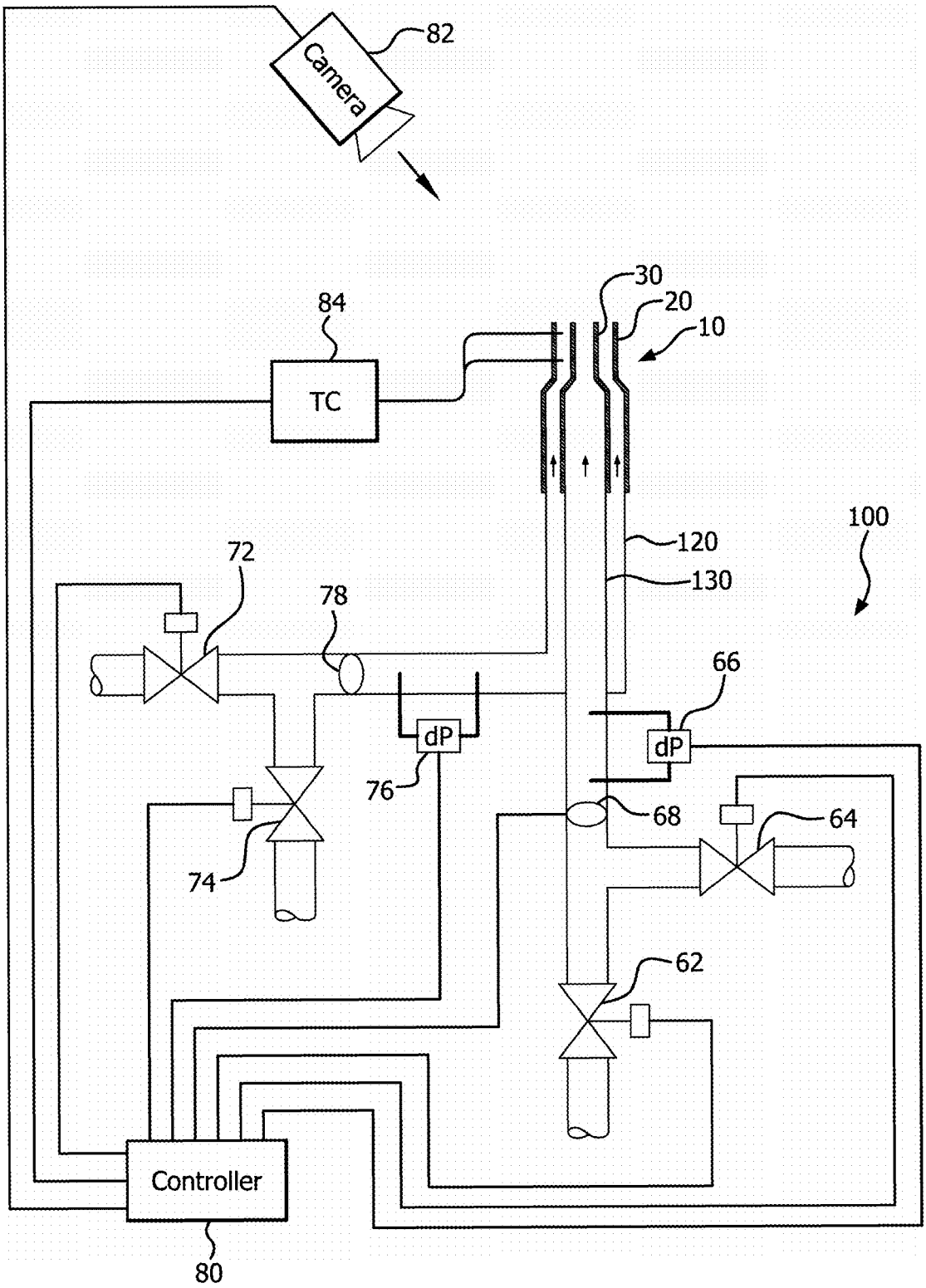
FIG. 4 is a schematic of a control system for operating a tuyere as in FIG. 1 in its various modes of operation.

A system 100 for controlling the tuyere 10 is shown in FIG. 4. An outer conduit 120 feeds fluid to the outer tube 20 of the tuyere 10 and an inner conduit 130 feeds fluid to the inner tube 30 of the tuyere 10. The outer conduit 120 is supplied with either an inert gas via a control valve 62 or an oxidant via a control valve 64, while the inner conduit 130 is supplied with either an inert gas via a control valve 72 or a fuel via a control valve 74. A controller 80 operates the control valves 62, 64, 72, 74 based on a desired operational mode and possible also based on feedback from various sensors. The controller 80 is programmed to ensure that, during operation of the tuyere 10, either valve 62 or valve 64 is always open, and either valve 72 or valve 74 is always open, to maintain a continuous flow through the tuyere 10 for cooling purposes. During stirring mode, the controller 80 opens valves 62 and 72 to flow an inert gas through both tubes 20, 30 of the tuyere 10. During burner mode, the controller 80 opens valves 64 and 74 to flow a fuel and an oxidant through the tuyere 10, essentially using the tuyere 10 as a burner.

The controller 80 can be programmed to do a cyclic process of switching between stirring mode and burner mode based on a process requirement. Additionally, the controller 80 can receive signals from sensors to switch between the stirring mode and burner mode. The sensors can be temperature sensors, for example, one or more thermocouple elements 84 installed near the nozzles 28, 38 the tuyere 10, differential pressure gauges 66, 76, flow gauges 68, 78, and/or a cameras 82.

In one example, consider a tuyere 10 initially operating in the stirring mode. If the camera 82 detects a buildup or bridging around the tuyere nozzles 28, 38, or one of the differential pressure gauges 66, 76 indicates a value that deviates from an expected value (e.g., due to a potential partial blockage at the tuyere exit), the controller 80 can activate the burner mode by closing valves 62, 72 and simultaneously opening valves 64, 74, The heat release from the flame produced in burner mode aids in melting the partial blockage or removing the bridge formation above the exit of near the nozzles 28, 38, of the tuyere 10. Once the bridging is removed or blockage is eliminated, the controller 80 can switch the tuyere 10 back to stirring mode by opening the appropriate valves for inert gas and closing the valves that supply the fuel and oxidizer.

Figure 5:
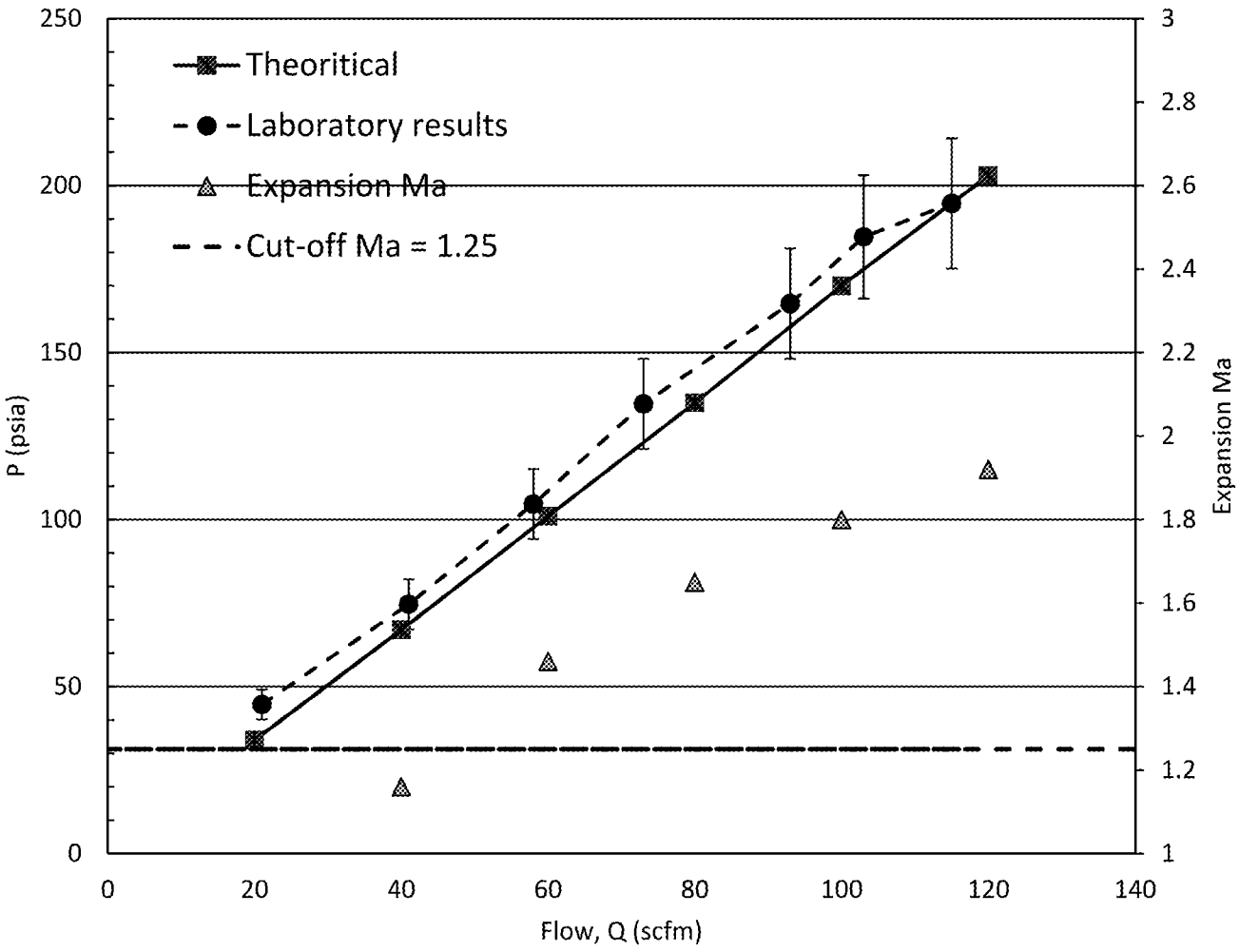
FIG. 5 is a graph showing gas flow rate versus pressure through a converting inner nozzle of a tuyere as in FIG. 1.

A prototype tuyere 10 having dimensions in the range as described herein was manufactured and tested in a laboratory setting to verify device functionality and operation in the two operating modes: stirring mode and burner mode. This testing confirmed that the tuyere 10 functions and operates as expected. FIG. 5 shows the theoretical and laboratory-determined flow-pressure characteristics for the prototype tuyere. This plot also shows the expansion Mach number for the prototype tuyere. The left-hand side Y-axis is for fluid supply pressure and right-hand side Y-axis is for the expansion Mach number. The plot shows that at supply pressures above 80 psia, the expansion Mach number is above 1.25 and the tuyere operates in the jetting regime. Furthermore, the plot shows that the supply pressures are achievable using a standard gas supply tank or an air separation unit, without the use of a compression device, to achieve jetting flow regime. Additionally, measured flow-pressure characteristics in the laboratory are within 10% of the theoretical determined pressure-flow characteristics of the tuyere.

Figure 10B:
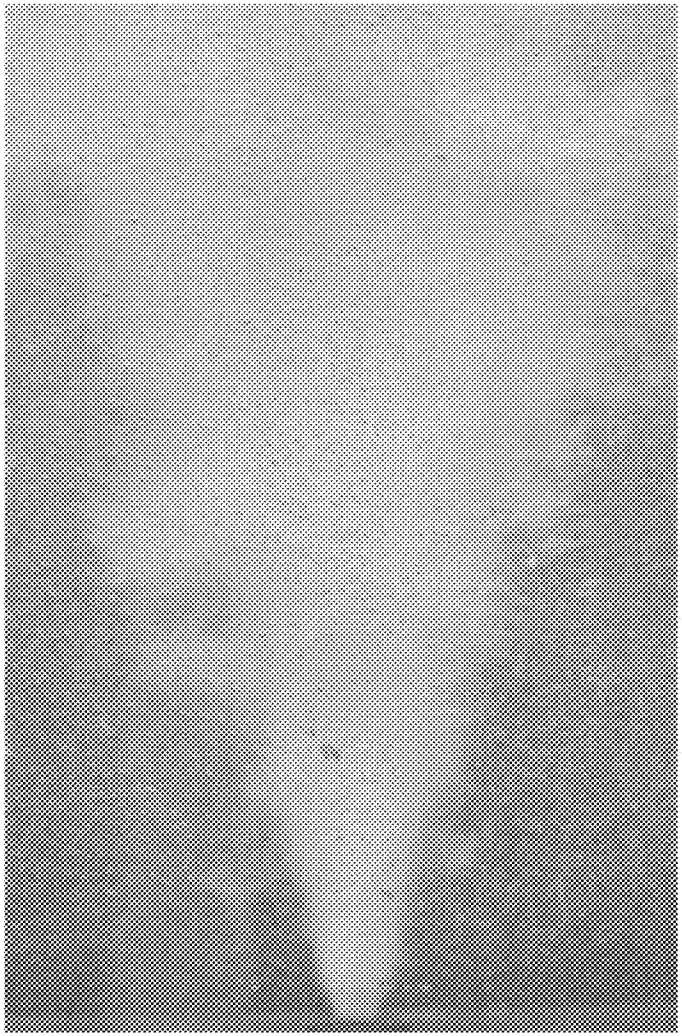
FIGS. 10A and 10B are photographs show a tuyere operating in its two modes outside of a BOF during testing.
Figure 10A:
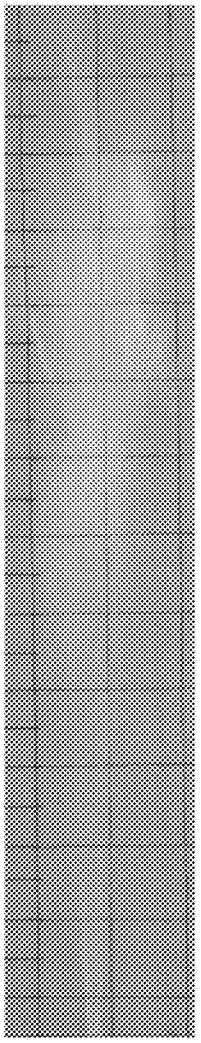

The prototype tuyere operation was also tested in the burner mode. The tuyere produces a stable flame in firing rate range of 0.05 to 1.00 MMbtu/hr. FIG. 10A shows an image of the high momentum, non-premixed, 0.4 MMBtu/hr flame produced by this tuyere. FIG. 10B shows a stable jet produced by a prototype tuyere in the stirring mode in a pool of water.

Figure 9:
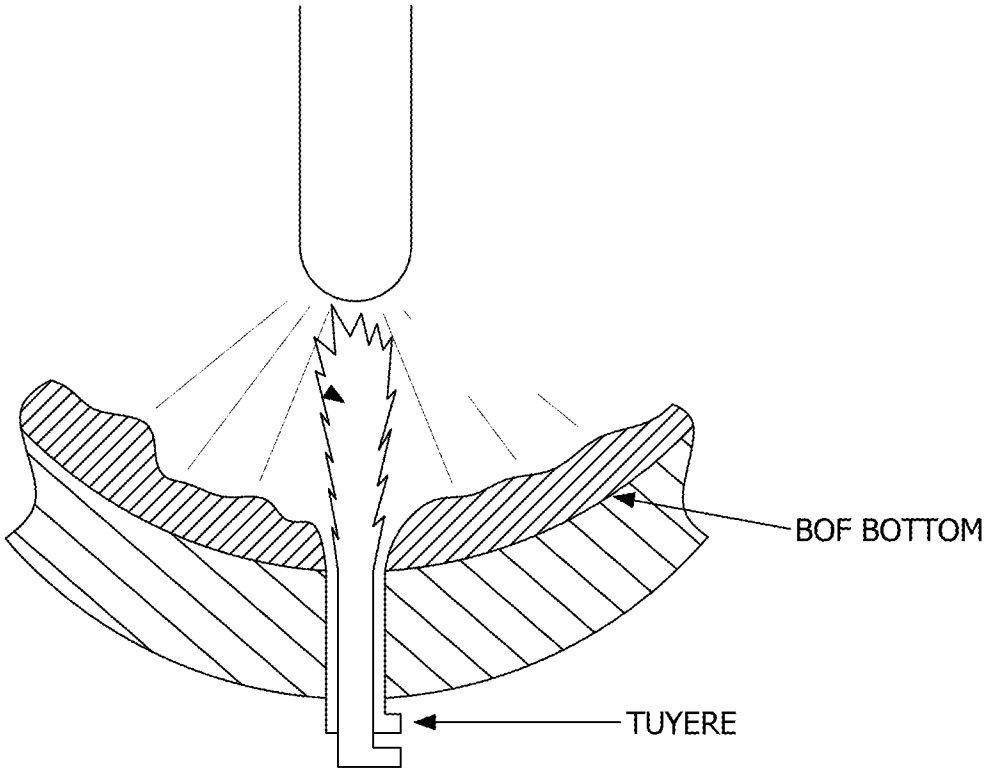
FIG. 9 is schematic sectional view showing an embodiment of a process in which a high momentum flame or thermal jet is exhausted from a tuyere as in FIG. 1 during slag splashing to reduce the likelihood of bottom stir tuyere clogging.

Additionally, the burner mode of operation of tuyere was tested in a pool of molten slag. The flame was stable and operated well in a molten pool of slag creating a clear open hole through the slag layer above the tuyere exit as shown schematically in FIG. 9.

Figure 6:
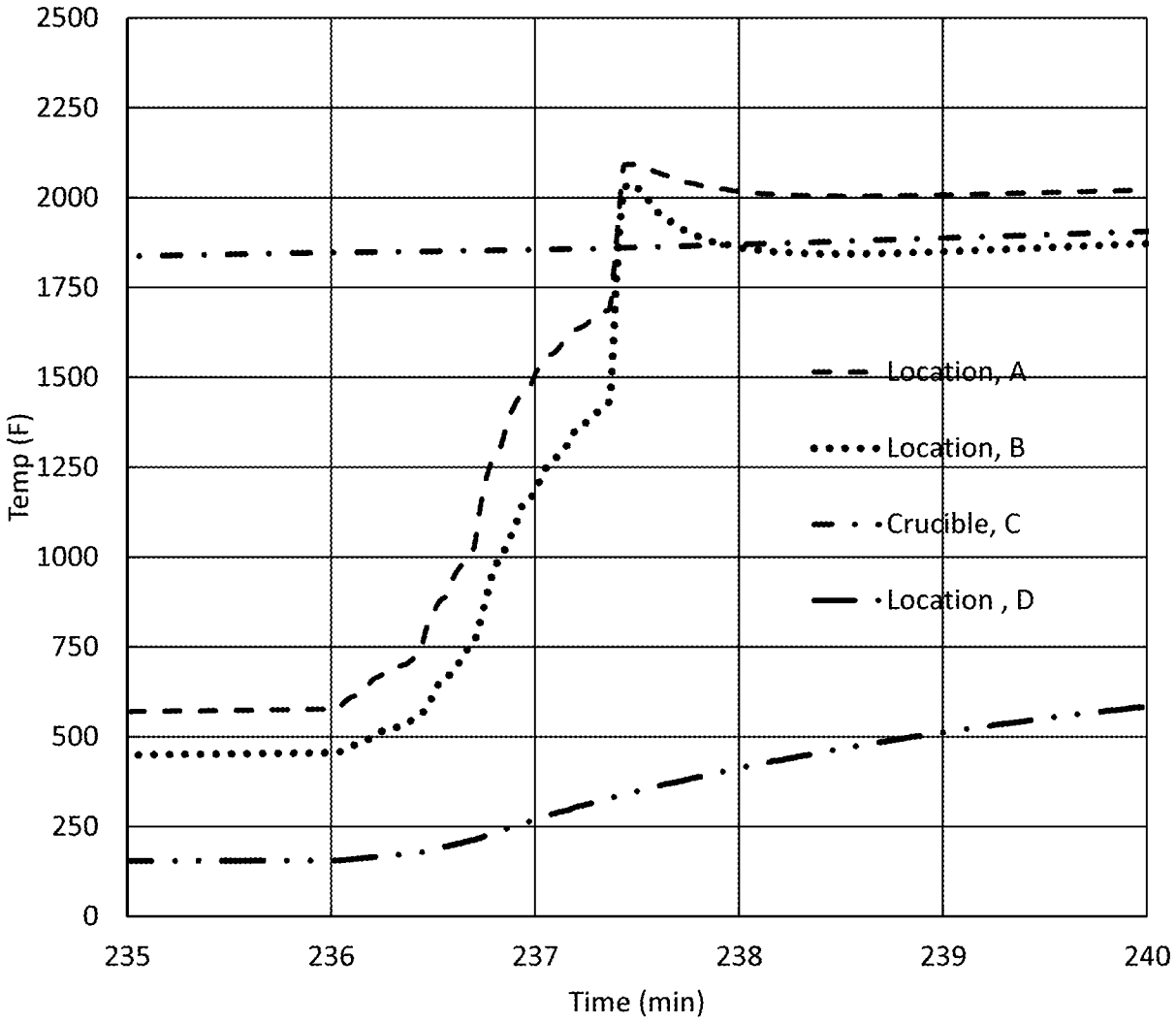
FIG. 6 is a graph showing measured temperature rise due to molten metal backflow into a tuyere as in FIG. 1 in the event of failure during submerged combustion.

The control mechanism of detecting tuyere blockage and sending feedback to the tuyere control valve was also tested in the laboratory. In this prototype design, thermocouples and flow rate measurement devices were used as active sensor elements to test and validate the control mechanism. Thermocouples were installed in the refractory crucible and inside the tuyere at several critical locations. A molten pool of slag and metal was created in a refractory crucible above the exit of the tuyere. To simulate a condition of loss of fluid flow, the flow rate of gas was reduced to zero. FIG. 6 presents temperature data obtained from the installed thermocouples in the refractory crucible and prototype tuyere. The temperature and time are on the y-axis and x-axis, respectively. The flow rate of gas was reduced to zero after 236 minutes of run time. FIG. 6 shows that when the flow starts to reduce, the molten metal or slag flows back inside the tuyere resulting in increase in the temperature reading of thermocouples A, B and D. The crucible temperature stayed close to 1775° F. during this operation. The increase in temperature reading of thermocouples A and B was close to 725 F/min and was used to provide feedback to the controller to initiate the secondary flow to avoid further backflow of molten metal or slag in the tuyere. The thermocouple reading D shows temperature rise of tube due to loss of cooling effect of the fluid flow. The temperature reading D was lower than thermocouples A and B as the molten material did not reach as far as the location of thermocouple D.

The self-sustaining tuyeres function in two modes of operation. During the blow phase of the BOF, the tuyeres function in a Bottom Stirring (BS) mode, in which inert gases flow through the nozzles at a rate sufficient to achieve effective stirring of the molten steel in the furnace. During the slag splash phase of the BOF the tuyeres function in a Slag Splashing (SS) mode, in which a combination of fuel and oxidant, and optionally inert gases flow through the tuyere.

Figure 8:
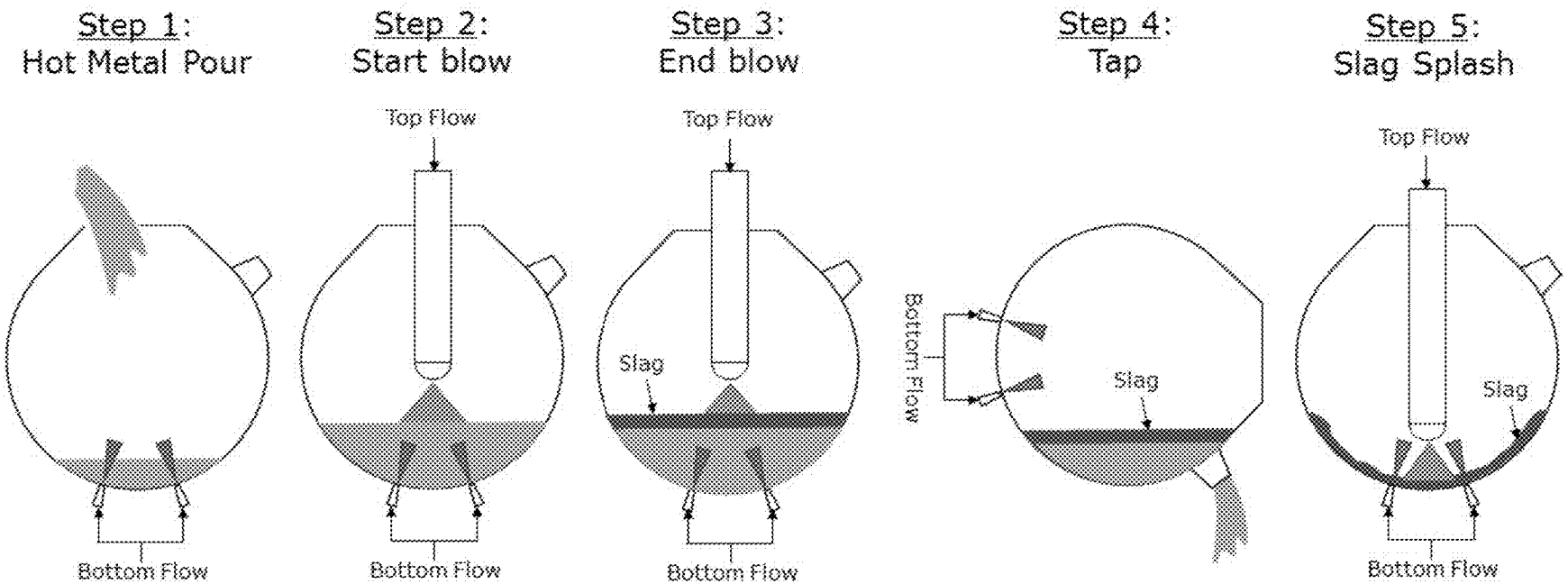
FIG. 8 is a schematic showing a sequence of operation of an embodiment of a modified BOF steel making process using bottom stirring and a process as described herein for inhibiting bottom stir tuyeres from clogging during slag splashing.

More specifically, FIG. 8 illustrates the operation strategy of the self-sustaining bottom stir tuyeres, and in particular, illustrates how the proposed process differs from the standard process of BOF steelmaking. In Steps 1 to 3 (during the pour phase and the blow phase), the bottom stir tuyeres operate in the stirring mode, while in Steps 4 to 5 (during the tap phase and the slag splash phase), the bottom stir tuyeres operate in the burner mode.

In Step 1 (Hot Metal Pour), a flow of inert gas through both nozzle passages is initiated (or continued) prior to starting the pour of hot metal into the furnace, and the flow of inert gas is maintained through the pour. This prevents the bottom stir nozzle from overheating and/or clogging. In Step 2 (Start Blow), the flow of inert gas through both nozzle passages is continued, at the same or a different flow rate, to achieve stirring of the molten metal. In Step 3 (End Blow), the flow of inert gases is continued as during Step 2. During steps 1 through 3, the most effective results are achieved by flowing inert gases such as argon, nitrogen, carbon-dioxide, or combinations thereof through both the primary nozzle and the secondary nozzle of the tuyere.

In Step 4 (Tap), when the BOF vessel is tilted to pour the metal out, the flow through the nozzle passages is switched over to fuel through one passage and oxidant through the other passage, to produce a flame (the furnace walls are sufficiently hot to cause auto-ignition of a fuel-oxidant mixture exiting the nozzles). Combustion, in the form of a flame exiting each bottom stir tuyere, must be commenced prior to the start of the slag splashing operation. In Step 5 (Slag Splash), the flames prevent the tuyeres from clogging, and also prevent the formation of bridges. Thus, during Steps 4 and 5, fuel and oxidant are introduced through the nozzles. It is preferable to introduce oxidant through the primary nozzle and fuel through the secondary nozzle. However, the vice-versa arrangement may also be used. Additionally, a diluent gas such as nitrogen or air maybe added to the flow through either or both the primary nozzle and the secondary nozzle to help manage the location of heat release (i.e., how far away from the nozzles the bulk of combustion occurs) and the volumes or momentum required to provide the desired flow profile (i.e., adding nitrogen or air increases the volumetric flow rate or momentum). This can be accomplished by adjusting the ratio or relative proportion of diluent gas to oxidant and/or fuel.

Sensors may be used to enhance the ability to detect and prevent nozzle clogging. In one embodiment, pressure transducers are installed at or near the tuyere exit end to detect clogging or bridging of the nozzles, which would cause a back-pressure increase. Pressure sensors may also be used to detect erosion of the nozzles and damage of the converging-diverging and/or cavity features of the nozzles, as exhibited by variations in pressure drop. In another embodiment, thermocouples may be installed at or near the tuyere exit end to detect deviation of temperatures from normal operation due to erosion of nozzles and seeping of molten metal through the nozzle.

The present invention is not to be limited in scope by the specific aspects or embodiments disclosed in the examples which are intended as illustrations of a few aspects of the invention and any embodiments that are functionally equivalent are within the scope of this invention. Various modifications of the invention in addition to those shown and described herein will become apparent to those skilled in the art and are intended to fall within the scope of the appended claims.

The invention claimed is:

1. A tuyere comprising:

an inner tube including a lower section having a first diameter, an upper section having a second diameter that is smaller than the first diameter, and a converging transition section having a converging angle Θ from 30° to 60° connecting the inner tube lower section to the inner tube upper section, the inner tube terminating in an inner nozzle at a downstream end of the inner tube upper section;

an outer tube surrounding the inner tube so as to create an annulus therebetween, the outer tube including a lower section having a third diameter that is larger than the first diameter, an upper section having a fourth diameter that is smaller than the third diameter but larger than the second diameter, and a converging transition section having connecting the outer tube lower section to the outer tube upper section, the outer tube terminating in an outer nozzle at a downstream end of the outer tube upper section;

a first inert gas valve configured to supply an inert gas to the inner tube and a fuel valve configured to supply a fuel to the inner tube;

a second inert gas valve configured to supply an inert gas to the outer tube and an oxidant valve configured to supply an oxidant to the outer tube; and a controller programmed to operate the tuyere in a stirring mode or a burner mode, wherein in the stirring mode the first inert gas valve and the second inert gas valve are open while the fuel valve and the oxidant valve are closed, and wherein in the burner mode the fuel valve and the oxidant valve are open while the first inert gas valve and the second inert gas valve are closed;

wherein the tuyere is operable in two modes, a stirring mode in which a jet formed by the tuyere is in the jetting mode with an expansion Mach number from 0.75 to 2 and a burner mode in which a stable non-premixed flame is formed to enable clearing of any blockage of the inner nozzle or the outer nozzle.

2. The tuyere of claim 1, wherein the expansion Mach number is from 1.25 to 2 when the tuyere is operated in the jetting mode during stirring mode.

3. The tuyere of claim 1, further comprising:

a pair of diametrically opposed wires spirally wound around on outer surface of the upper section of the inner tube at a taper angle from 15° to 75°.

4. The tuyere of claim 1, further comprising:

a first pressure sensor in a conduit upstream of the inner tube of the tuyere configured to send a signal to the controller indicative of a first back-pressure in the inner tube of the tuyere; and a second pressure sensor in a conduit upstream of the outer tube of the tuyere configured to send a signal to the controller indicative of a second back-pressure in the outer tube of the tuyere;

wherein the controller is programmed to switch tuyere operation from the stirring mode to the burner mode when one or both of the first back-pressure and the second back-pressure deviates from a predetermined normal range of back-pressure in the tuyere.

5. The tuyere of claim 1, further comprising:

a temperature sensor configured to send a signal to the controller indicative of a temperature in the upper section of the outer tube of the tuyere;

wherein the controller is programmed to switch tuyere operation from the stirring mode to the burner mode when the temperature deviates from a predetermined normal range of temperature in the tuyere.

6. The tuyere of claim 1, further comprising:

a camera configured to send a visual image of the inner nozzle and the outer nozzle of the tuyere to the controller;

wherein the controller is programmed to switch tuyere operation from the stirring mode to the burner mode when the visual image indicates partial blockage of one or both of the inner nozzle and the outer nozzle.

* * * * *